United States Patent [19]

Fukada

[11] Patent Number: 4,675,939

[45] **Date of Patent: * Jun. 30, 1987**

[54] A CURTAIN RUNNER WITH AN AXIALLY REMOVABLE ROD

[75] Inventor: Hiroo Fukada, Tokyo, Japan

[73] Assignee: Toso Company, Limited, Japan

[ * ] Notice: The portion of the term of this patent subsequent to Jul. 2, 2002 has been disclaimed.

[21] Appl. No.: 696,271

[22] PCT Filed: Jun. 7, 1984

[86] PCT No.: PCT/JP84/00293

§ 371 Date: Jan. 14, 1985

§ 102(e) Date: Jan. 14, 1985

[87] PCT Pub. No.: WO84/04875

PCT Pub. Date: Dec. 20, 1984

[30] Foreign Application Priority Data

Jun. 8, 1984 [JP] Japan ..... 58-86329

[51] Int. Cl.[4] ..... A47H 15/02

[52] U.S. Cl. ..... 16/87.2; 16/87.4 R; 16/102

[58] Field of Search ..... 16/87 R, 87.2, 87.4 R, 16/97, 98, 102, 105; 403/375; 24/238, 241 SL, 297

[56] References Cited

U.S. PATENT DOCUMENTS

| | | | |
|---|---|---|---|
| 2,783,493 | 3/1957 | Gussack | 16/97 |
| 3,193,870 | 7/1965 | McNinch | 16/105 X |
| 4,525,893 | 7/1985 | Fukada | 16/102 |

FOREIGN PATENT DOCUMENTS

| | | | |
|---|---|---|---|
| 371927 | 10/1963 | Switzerland | 24/297 |
| 1012703 | 12/1965 | United Kingdom | 24/297 |
| 2105179 | 3/1983 | United Kingdom | 16/87 R |

*Primary Examiner*—Fred Silverberg

*Attorney, Agent, or Firm*—Birch, Stewart, Kolasch & Birch

[57] ABSTRACT

A curtain runner comprising a runner body (10) made of a synthetic resin previously mounted in a curtain rail (40) with a curtain rod (30) vertically mounted to and coupled with the runner body. The rubber body is shaped in a box with a bore (15) in the bottom wall. The rod has a head (31) larger in diameter than the other portion thereof. A sleeve (20) is fitted from the bottom in the bore and provided with top and bottom flanges (21, 22) larger in diameter than the bore. The axial hole (24, 26) of the sleeve except for the top portion (25) thereof, is larger in diameter than the head. The sleeve has the upper portion thereof formed with a plurality of slits (23) to contract the top flange smaller than the bore when it is fitted in the bore and expand the top portion of the axial hole larger than the head when the head passes through the sleeve. The axial hole has its bottom portion (26) which can be downwardly widened in the form of a funnel and provided with a lowermost diameter several times larger than the head, so that the rod is smoothly fitted in the sleeve, even if the rod and the sleeve are axially shifted from each other.

2 Claims, 14 Drawing Figures

A CURTAIN RUNNER WITH AN AXIALLY REMOVABLE ROD

TECHNICAL FIELD

The present invention relates to improvements in a curtain runner of the type having a runner body movable on a rail and a curtain rod vertically fitted in the runner body.

BACKGROUND ART

A curtain rail in a high position or narrow box without reach of one's hand needs such curtain runners as disclosed under JP, U, 59-44386. The runner has a runner body and a rod vertically fitted in the runner body. The rod is pushed to the bottom of the runner body for coupling with the runner body which is previously mounted in a rail. The rod is generally attached to a curtain cloth after it has been coupled with the runner body but sometimes is fixed to a light cloth before it is fitted in the runner body. The runner body is shaped in the form of a box which is provided at the top with a pair of wheels for rotatable movement within a curtain rail. The body has a bottom wall formed with a bore in which a split sleeve is fitted. The sleeve has top and bottom flanges each having a plurality of splits to expand and contract itself. The bottom flange can be contracted smaller than the bore in the bottom wall of the body when being inserted into the bore from within. The sleeve, after fitted in the bore, has the top flange placed on the peripheral edge of the bore. The curtain rod has an expanded head to be inserted into an axial hole of the sleeve from the bottom. The head is larger than the top portion of the axial hole but smaller than the other portion of the hole. Upon insertion of the head into the axial hole, the head raises the sleeve to the uppermost position and then causes the top flange to expand the narrow top portion of the axial hole in a manner that it passes through the sleeve. The head, after passed through the axial hole, is released or lowered to rest on the top flange which has returned as it is.

The curtain runner as disclosed has the sleeve to be fitted in the bore of the runner body from within, so that the bottom flange can not be large enough to guide the expanded head of the curtain rod into the axial hole. Therefore, the rod does not fit easily into the axial hole of the sleeve if the rod and the sleeve are axially shifted from each other. It is particularly difficult to fit the rod in the runner body in a curtain rail which is disposed in a high position or within a narrow box not within the reach of one's hand.

The present invention is intended to provide a curtain runner in which the curtain rod is easily fitted in the sleeve even if the rod is somewhat eccentrically pushed to the bottom of the sleeve.

DISCLOSURE OF INVENTION

To attain the object as described above, the invention consists in a curtain runner comprising a runner body in the form of a box of which the bottom wall is provided with a bore, a sleeve provided with top and bottom flanges fitted in the bore, and a curtain rod formed with an expanded head for coupling with the sleeve. The rod has an expanded head of which the outer diameter is larger than the other portion. The sleeve has an axial hole of which the top portion is narrowed to have an inner diameter smaller than the head. The sleeve has the upper half thereof formed with a plurality of slits to allow not only the top portion of the axial hole to expand larger than the head of the rod but also the top flange to contract smaller than the bore in the bottom wall.

The bottom flange or bottom portion of the axial hole can be shaped as a guide for easy insertion of the rod into the axial hole in the sleeve with restriction in size and shape of the bottom wall of the runner body. For example, the bottom portion of the axial hole is shaped in the form of a large funnel, so that the rod is smoothly guided by the conical surface of the bottom opening and automatically coaxially inserted to the top portion of the axial hole, resulting in that the rod is easily fitted in the runner body.

The advantages offered by the invention are mainly that the curtain rod is easily fitted in the runner body within a curtain rail which is mounted in a high position or within a narrow curtain box without reach of one's hand and that the curtain rod and the runner body are assembled to a complete curtain runner by a simple operation that the rod is vertically pushed to the runner body or the vicinity thereof. The rod can be fitted in the sleeve of the runner body even if it is somewhat shifted from the axis of the sleeve. The rod may be attached to the curtain cloth after or before it is coupled with the runner body.

BRIEF DESCRIPTION OF DRAWINGS

The present invention will become more fully understood from the detailed description given hereinbelow and the accompanying drawings which are given by way of illustration only, and thus are not limitative of the present invention, and wherein.

THE BEST MODE OF CARRYING OUT THE INVENTION

Figure 1:
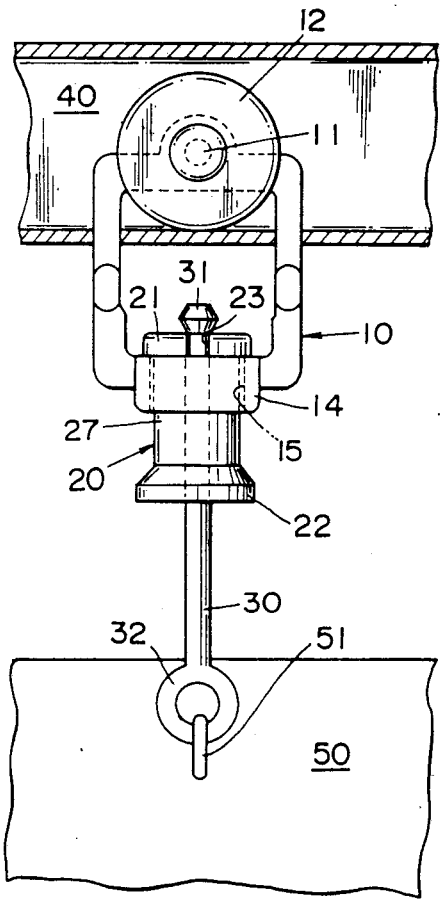
FIG. 1 is a front elevation of the curtain runner of the present invention.
Figure 2:
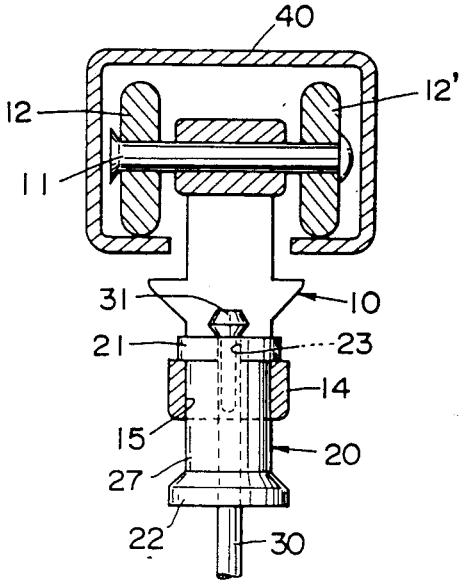
FIG. 2 is a section taken along the line II—II of FIG. 1.

As seen in FIGS. 1 and 2, the runner body 10 of synthetic resin is generally shaped in the form of a box of which the top wall is provided with a shaft 11. A pair of wheels 12, 12' are rotatably mounted at the opposite ends of the shaft 11 to run within a curtain rail 40. The runner body 10 has the bottom wall thereof 14 formed with a bore 15 in which a sleeve 20 of resilient synthetic resin is fitted. The sleeve 20 has top and bottom flanges 21, 22 which are larger in diameter than the bore 15. The sleeve 20 has the upper portion thereof formed with a plurality of slits 23. The cylindrical portion 27 between the top and bottom flanges 21, 22 has an axial length equal to or larger than the sum of the length of slit 23 and the thickness of the bottom wall 14. The rod 30 has at a top end an expanded head 31 projected from the sleeve 20 and at a bottom end a ring 32 to which a hook 51 of a curtain cloth 50 is attached.

Figure 3:
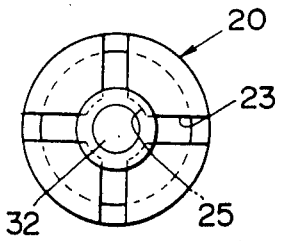
FIGS. 3 to 5 are enlarged plan, side and bottom plan views of the sleeve and the rod of FIG. 1.
Figure 4:
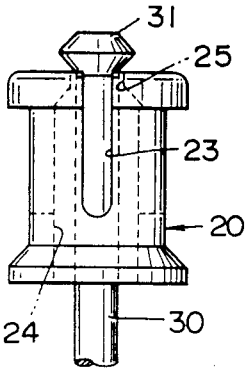
Figure 5:
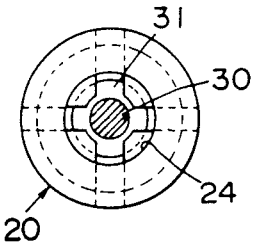
Figure 8:
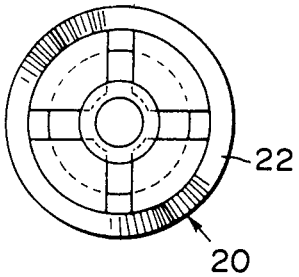
FIGS. 8 to 11 are views of another embodiment, similar to FIGS. 3 to 6.
Figure 6:
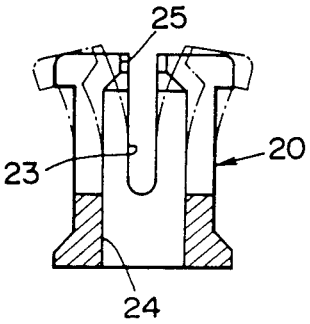
FIGS. 6 and 7 are enlarged sections of the sleeve of FIG. 1, illustrating the expansion and contraction of the top flange by dotted lines.
Figure 9:
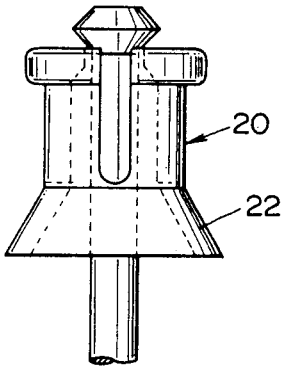
Figure 7:
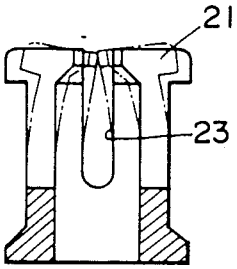
Figure 10:
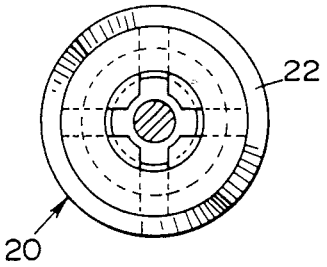
Figure 11:
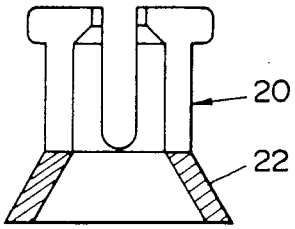

As seen in FIGS. 3 to 5, the sleeve 20 has four crossed slits 23 in the upper portion thereof. An axial hole 24 in the sleeve is larger in diameter than the expanded head 31 of the rod 30 except the top portion thereof which is smaller than the head 31. The slit 23 is so arranged that the top portion 25 of the hole 24 is expandable larger than the head 31 as shown by the dotted line in FIG. 6 and that the top flange 21 is contractible smaller than the bore 15 as shown by the dotted line in FIG. 7. Thus, the sleeve is easily fitted in the bore in the runner body when the top flange 21 is contracted and prevented from slipping out of the bore when the top flange is returned as it is.

In the embodiment of FIGS. 8 to 11, the sleeve 20 is similar to that in the previous except for the bottom flange and the bottom portion of the axial hole. The bottom flange 22 as well as the bottom portion 26 of the axial hole is so shaped in the form of a cone or funnel to have a lowermost inner diameter several times larger than that of the expanded head of the rod.

Figure 12:
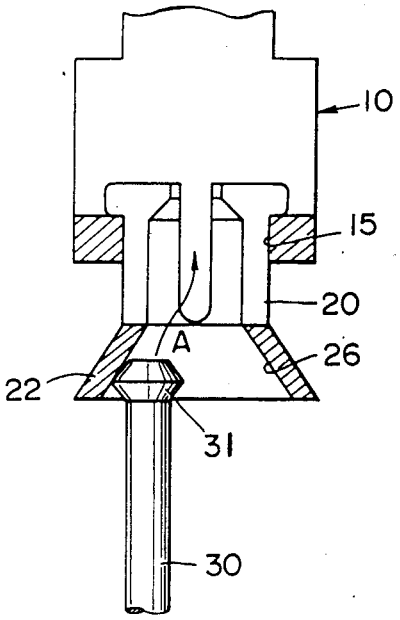
FIGS. 12 to 14 are sections of the embodiment, illustrating fitting processes.
Figure 13:
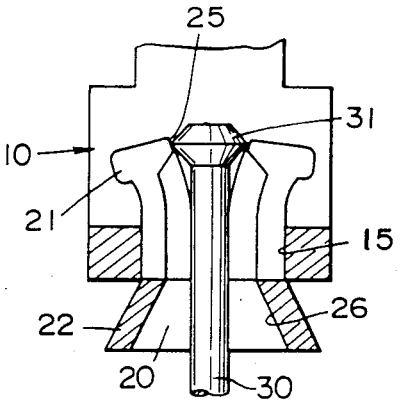
Figure 14:
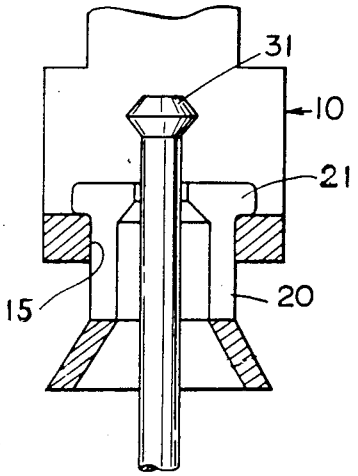

The manner of fitting the rod in the sleeve will be explained with reference to FIGS. 12 to 14, in which the sleeve 20 is the same as shown in FIGS. 8 to 11. When the rod 30 in the bore 15 is pushed to the runner body 10, it is guided by the conical inner surface of the bottom portion 26 of the axial hole 24 within the bottom flange 22 as shown by an arrow A in FIG. 12. Thus, the head 31 is automatically pushed to the center of the hole 24 even if the rod and the sleeve are eccentrically coupled with each other. Thereafter, as seen in FIG. 13, the rod 30 has the head 31 in contact with the top portion 25, so that the sleeve 20 in the body 10 is raised to have the bottom flange 22 in contact with the bottom edge of the bore 15, whereby the top flange 21 is caused to widen and and permit the head 31 to pass therethrough. After the head 31 has projected from the sleeve 20, the sleeve 20 is lowered to have the top flange 21 returned as it is and placed on the edge of the bore 15 as seen in FIG. 14. When the rod is released or pulled down, the head 31 is lowered to rest on the top of the sleeve. The curtain cloth has hooks to be hung on the ring at the bottom of the rod after or before the rod is fitted in the runner body.

From the foregoing, the curtain runner of the invention makes it easy to hang a curtain cloth by a curtain rail in a high position or within a narrow and deep curtain box without being in reach of one's hand because the rod is automatically guided to the center of the sleeve, even if the rod is somewhat eccentrically raised with respect to the runner body previously mounted in the curtain rail.

I claim:

1. A curtain runner adapted to be mounted in an curtain rail comprising a runner body in the form of a box and having a top wall and a bottom wall formed with a bore, a pair of wheels mounted in said top wall of said runner body for movement within said curtain rail, a sleeve with top and bottom flanges made of a resilient material and moveably fitted in said bore, an axial hole formed in said sleeve, a rod adapted to be inserted into said axial hole and attached to a curtain cloth, said rod having an enlarged head larger in diameter than said head with a remaining portion thereof being larger in diameter than said head, and said sleeve having an upper portion thereof formed with a plurality of slits which allow said top flange to be contracted smaller than said bore whereby the sleeve can be mounted in the runner body from the underside and expand the top portion of said axial hole wider than said head for mounting said head from beneath, wherein the curtain cloth is supported by the enlarged head portion of the rod engaging said to flange and said top flange engaging the runner body.

2. The curtain runner as claimed in claim 1, wherein said axial hole has a bottom portion which flairs out in the form of a funnel-shaped bottom flange.

* * * * *